US006034575A

United States Patent [19]

Watanabe

[11] Patent Number: 6,034,575

[45] Date of Patent: Mar. 7, 2000

[54] VARIABLE ATTENUATOR

[75] Inventor: Shin Watanabe, Kawasaki, Japan

[73] Assignee: Fujitsu Limited, Kawasaki, Japan

[21] Appl. No.: 09/041,705

[22] Filed: Mar. 13, 1998

[30] Foreign Application Priority Data

Aug. 7, 1997 [JP] Japan ..... 9-213181

[51] Int. Cl.[7] ..... H01P 1/22

[52] U.S. Cl. ..... 333/81 A; 257/537

[58] Field of Search ..... 333/81 R, 81 A; 257/536, 537; 338/20

[56] References Cited

U.S. PATENT DOCUMENTS

| | | | |
|---|---|---|---|
| 2,934,723 | 4/1960 | Hewitt, Jr. | 333/81 A |
| 3,432,778 | 3/1969 | Ertel | 333/81 R |
| 3,867,707 | 2/1975 | Pering et al. | 333/81 A X |
| 4,090,155 | 5/1978 | Tateno et al. | 333/81 A X |
| 4,216,445 | 8/1980 | Abajian | 333/81 R |
| 4,309,626 | 1/1982 | Kudo | 257/537 X |
| 4,359,699 | 11/1982 | Horkin | 333/81 A |
| 5,767,757 | 6/1998 | Prentice | 257/536 X |

FOREIGN PATENT DOCUMENTS 4-167601 6/1992 Japan .

*Primary Examiner*—Paul Gensler
*Attorney, Agent, or Firm*—Armstrong Westerman Hattori McLeland & Naughton

[57] ABSTRACT

A variable attenuator includes a resistance region, a signal line to which the resistance region is connected, a very high frequency signal being propagated through the signal line, and a voltage applying part which applies a dc voltage across the ends of the resistance region, the dc voltage controlling a magnitude of attenuation to the very high frequency signal.

10 Claims, 16 Drawing Sheets

VARIABLE ATTENUATOR

BACKGROUND OF THE INVENTION

1. Field of the Invention

The present invention generally relates to a variable attenuator, and more particularly to a variable attenuator formed on a semiconductor substrate or chip.

Recently, communication devices such as portable telephone sets have been designed to positively employ integrated circuits in order to meet the requirements for down sizing and lightening. Particularly, there is a need for an integrated circuit operable in the microwave band and a very high frequency band such as the milliwave band higher than 30 GHz. Such an integrated circuit has a circuit configuration capable of signals of very high frequencies. In many cases, such a circuit configuration is equipped with a configuration which attenuates the signals to a given level in order to prevent signals of excessive large levels from being applied to circuit components. Hence, there is a need for a variable attenuator which is simple and has high performance.

2. Description of the Related Art

FIG. 1 is a block diagram of a receive front end of a wireless device such as a portable telephone set. The receive front end includes an antenna 100, a band-pass filter 101, a low-noise amplifier 102, a variable attenuator 103, a frequency converter 104, a level detection diode 105 and a local oscillator 106.

A signal received via the antenna 101 is applied to the low-noise amplifier 102 via the band-pass filter 101 so that noise components contained therein can be eliminated. The low-noise amplifier 102 amplifies the fine received signal. The amplified output signal of the low-noise amplifier 102 s applied to the frequency converter 104 and the level detection diode 105 via the variable attenuator 103.

The level detection diode 105 outputs a detection signal PD indicating the level of the amplified signal. The detection signal PD is used to indicate the receive electric intensity and control the variable attenuator 103. The variable attenuator 103 controls the magnitude of attenuation to the amplified signal so that the input signal level of the frequency converter 104 falls within a predetermined range. The local oscillator 106 oscillates a local oscillation signal LO, which is applied to the frequency converter 104 and is mixed with the amplified high-frequency signal. An intermediate frequency signal IF thus obtained is then applied to the next stage (not shown) at which an intermediate frequency amplifier is located, for example.

A block of a one-dot chained line shown in FIG. 1 denotes an MMIC (Monolithic Microwave Integrated Circuit). For example, a configuration shown in FIG. 2A is used to form the receive front end used in the milliwave band. The configuration shown in FIG. 2A consists of a low-noise amplifier 112 and a frequency converter 114. The low-noise amplifier 112 amplifies a high-frequency signal RF, which is applied to the frequency converter 114 receiving, on the other side, the local oscillation signal LO generated by the local oscillator (not shown). Then, the frequency converter 114 generates the intermediate frequency signal IF from the two received signals. It is not easy to control the signal levels in the milliwave band. Hence, the variable attenuator 103 employed in the configuration shown in FIG. 1 is not used in the configuration shown in FIG. 2A.

A configuration shown in FIG. 2B is used to form the receive front end in the microwave band. The configuration shown in FIG. 2B includes a low-noise amplifier 122, a variable gain amplifier 123, a frequency converter 124, a level detection diode 125. These components are formed by an MMIC.

The high-frequency signal RF is amplified by the low-noise amplifier 122. The amplified output signal is applied to the variable gain amplifier 123, which controls the gain to obtain the predetermined signal level. The output signal of the variable gain amplifier 123 is then applied to the frequency converter 124, which receives the local oscillation signal LO from the local oscillator (not shown). The frequency converter 124 mixes the RF signal from the variable gain attenuator 123 with the local oscillation signal LO, and thus generates the intermediate frequency signal IF. The level detection diode 125 detects the amplified output signal of the variable gain amplifier 123 and thus generates the level detection signal PD.

Generally, the variable gain amplifier 123 is formed, in the microwave band, of a field-effect transistor having a dual-gate structure. The gain control is realized by adjusting the bias applied to a gain control gate terminal of the field-effect transistor.

The receive front end is the important part which determines the receive performance and is required to have a reduced noise level. Hence, the low-noise, high-gain amplifiers 102, 112 and 122 are used. If the amplifiers 102, 112 and 122 output amplified signals having relatively large amplified levels, the frequency converters 104, 114 and 24 of the next stage will receive excessively high levels. Hence, the intermediate frequency signals IF are saturated. With the above in mind, the variable attenuator 103 and the variable gain amplifier 123 are employed.

In the microwave band, the variable gain amplifier 123 can be formed of the field-effect transistor of the dual-gate structure, as described above. However, the dual-gate structure will form a parasitic element in the milliwave band, and thus the variable gain amplifier 123 cannot be employed in the milliwave band. For the above reason, the low-noise amplifier 112 and the frequency converter 114 are formed by the MMIC, as has been described previously.

It is also desired to extend the dynamic range of the receive signal level. It is thus required that the MMIC receive front end used in the milliwave band can vary the signal level at the front end. It is very difficult to sufficiently extend the dynamic range by using the dual-gate field-effect transistor forming the variable gain amplifier 123 in the microwave band.

SUMMARY OF THE INVENTION

It is an object of the present invention to provide a variable attenuator suitable for an MMIC.

The above object of the present invention is achieved by a variable attenuator comprising: a resistance region; a signal line to which the resistance region is connected, a very high frequency signal being propagated through the signal line; and a voltage applying part which applies a dc voltage across the ends of the resistance region, the dc voltage controlling a magnitude of attenuation to the very high frequency signal.

The above variable attenuator may be configured so that: the resistance region is provided in the signal line; the variable attenuator further comprises capacitors provided in the signal line and located at both sides of the resistance region; and the voltage applying part comprises a portion which applies the dc voltage to both the sides of the resistance region and which interrupts the very high frequency signal.

The variable attenuator may be configured so that: the resistance region is connected between the signal line and ground; and the voltage applying part comprises a portion which applies the dc voltage to both the sides of the resistance region and which interrupts the very high frequency signal.

The variable attenuator may be configured so that: the resistance region is an impurity diffused region formed in a semiconductor substrate; and the signal line is formed on the semiconductor substrate.

The above object of the present invention is also achieved by a variable attenuator comprising: first and second resistance regions which are spaced apart from each other by a length equal to ¼ of a wavelength of a very high frequency signal; a signal line to which the first and second resistance regions are connected, the very high frequency signal being propagated through the signal line; and a voltage applying part which applies a dc voltage across the ends of the first and second resistance regions, the dc voltage controlling a magnitude of attenuation to the very high frequency signal.

The above objects of the present invention is also achieved by a variable attenuator comprising: first and second resistance regions which are spaced apart from each other by a length equal to ¼ of a wavelength of a very high frequency signal; a signal line to which the first and second resistance regions are connected, the very high frequency signal being propagated through the signal line; and a voltage applying part which applies different dc voltages across the ends of the first and second resistance regions, the dc voltages controlling a magnitude of attenuation to the very high frequency signal.

The above variable attenuator may be configured so that the first and second resistance regions have different resistance values.

The variable attenuator may be configured so that it further comprises a high-impedance line which has a length equal to ¼ of the wavelength of the very high frequency signal and which is provided in the signal line and is connected to the resistance region.

The above-mentioned object of the present invention is also achieved by a variable attenuator comprising: a first hybrid circuit connected to signal lines of an input side through which a very high frequency signal is propagated; a second hybrid circuit connected to signal lines of an output side; first and second resistance regions connecting the first and second hybrid circuits together; and a voltage applying part which applies a dc voltage across the ends of the first and second resistance regions, the dc voltage controlling a magnitude of attenuation to the very high frequency signal.

The above-mentioned object of the present invention is also achieved by a variable attenuator comprising: an input terminal receiving a very high frequency signal; an output terminal; a hybrid circuit which distributes the very high frequency signal to first and second output terminals; a first resistance region connected between the first terminal of the hybrid circuit and ground; a second resistance region connected between the second terminal of the hybrid circuit and ground; and a voltage applying part which applies a dc voltage across the ends of the first and second resistance regions, the dc voltage controlling a magnitude of attenuation to the very high frequency signal so that signal reflection can be controlled.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

First, a description will be given, with reference to FIGS. 3A and 3B, of the principle of the present invention.

Figure 1:
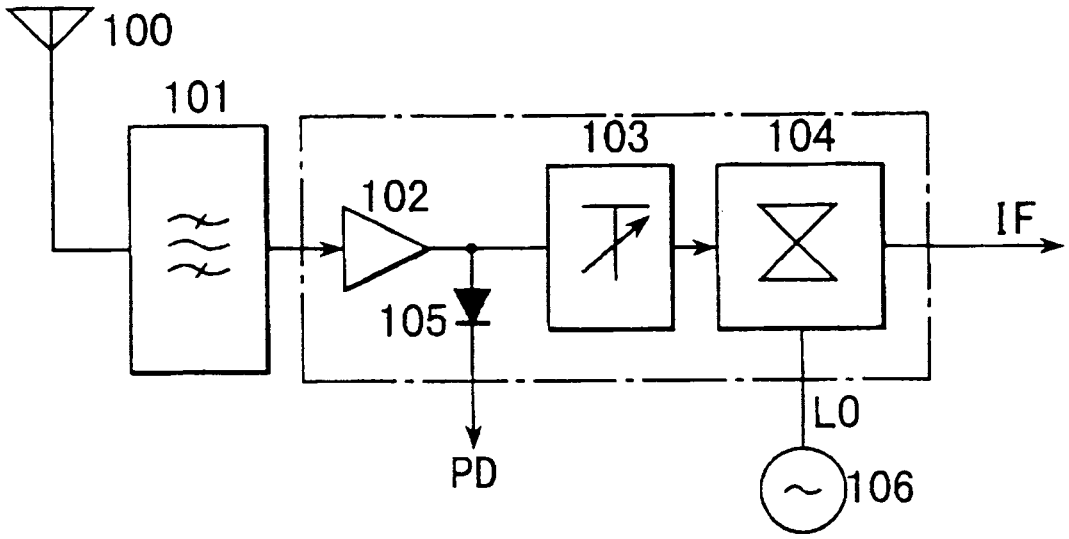
FIG. 1 PRIOR ART
FIG. 1 is a block diagram of a receive front end.
Figure 2A:
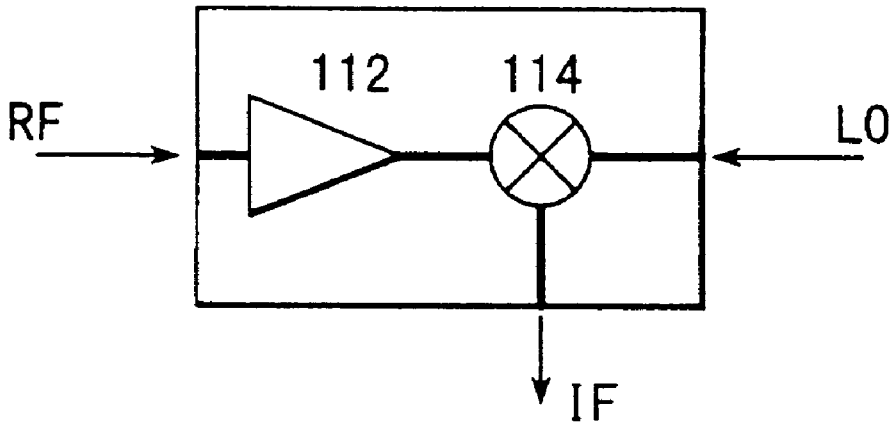
FIG. 2A PRIOR ART
FIGS. 2A and 2B are block diagrams showing how to implement the receive front end in an MMIC formation.
Figure 2B:
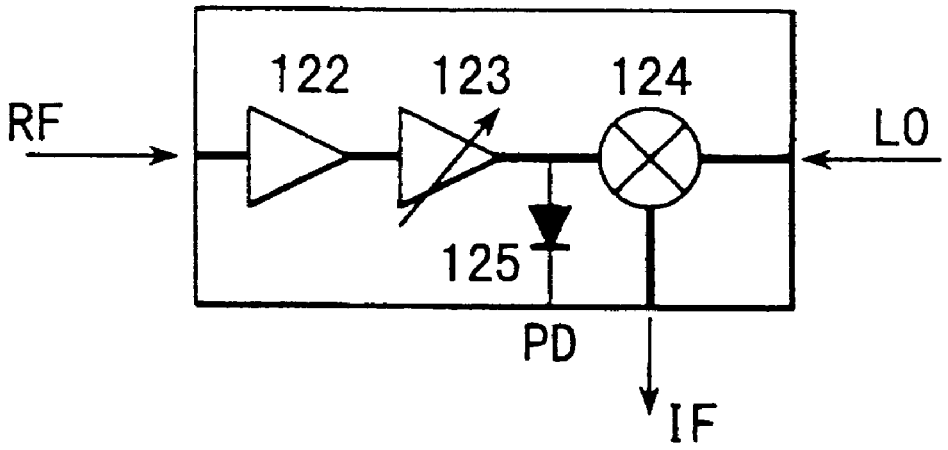
FIG. 2B PRIOR ART
Figure 3A:
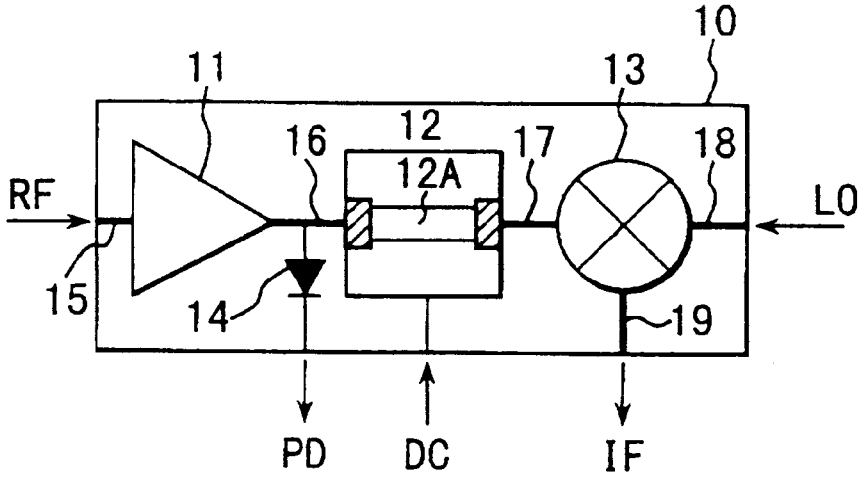
FIGS. 3A and 3B are diagrams showing the principle of the present invention.
Figure 3B:
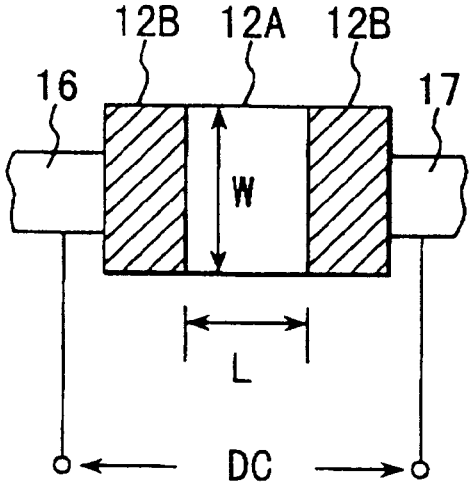

Referring to FIGS. 3A and 3B, a variable attenuator 12 of the present invention includes, a semiconductor substrate 10, a resistance region 12A, signal lines 16 and 17 and a voltage applying part. The resistance region 12A is formed by diffusing an impurity in the semiconductor substrate 10. The signal lines 16 and 17 are connected to both sides of the resistance and are, for example, microstrip lines over which very high frequency signals are transferred. The voltage applying part applies a dc voltage DC to both the sides of the resistance region 12A. The dc voltage DC controls the magnitude of attenuation to the very high frequency signal. The resistance region 12A provides such attenuation. A receive front end shown in FIG. 3A is configured in the MMIC formation. More particularly, the receive front end is formed so that a low-noise amplifier 11, a frequency converter 12, a level detection diode 14 and signal lines 15–19 such as microstrip lines are formed on the semiconductor substrate 10.

A received very high frequency signal RF is input to the low-noise amplifier 11 via the signal line 15, and is then amplified. The amplified signal is applied to the variable attenuator 12 via the signal line 16. The signal level is detected by the diode 14, which applies the detection signal PD to a control circuit (not shown in FIGS. 3A and 3B). The control circuit applies the dc voltage DC corresponding to the detected signal level to the variable attenuator 12, which adjusts the amplified signal so as to have the level dependent on the dc voltage DC within the predetermined range. The level-adjusted signal is then applied to the frequency converter 13, which receives the local oscillation signal LO via the signal line 18. The intermediate frequency signal IF is generated by the frequency converter 13, and is applied to the signal line 19.

The variable attenuator 12 includes the resistance region 12A obtained by diffusing an impurity in the semiconductor substrate 10, as described previously. FIG. 3B shows an outline of the resistance region 12A. Two connection electrodes 12B make ohmic contacts with the resistance region 12A. The dc voltage DC is applied across the resistance region 12A via the connection electrodes 12B. Hence, the magnitude of attenuation to the very high frequency signal RF provided by the resistance region 12A can be controlled.

Figure 4A:
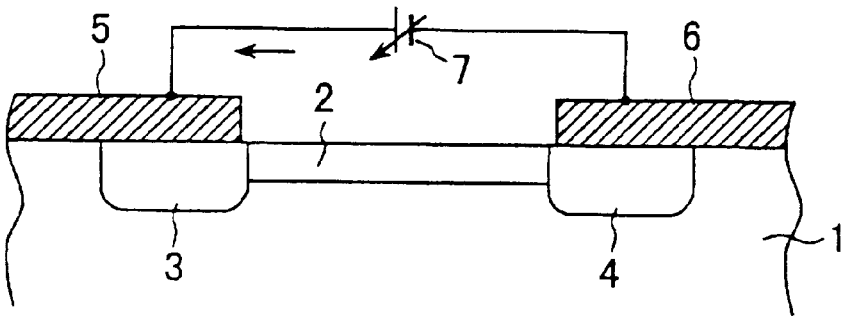
FIG. 4A is a cross-sectional view of a variable attenuator of the present invention.

FIG. 4A is a cross-sectional view of the variable attenuator 12, which includes a semiconductor substrate 1, an impurity diffused region 2, contact regions 3 and 4, and connection electrodes 5 and 6. A variable dc source 7 is connected across the connection electrodes 5 and 6. The semiconductor substrate 1 is, for example, a GaAs substrate, in which the resistance region 12A is formed together with the low-noise amplifier 11 and the frequency converter 13. These components are connected by the signal lines 15–19.

When the semiconductor substrate 1 is a GaAs substrate, Si is diffused therein at a concentration of, for example, $1\times10^{17}$ atoms/cm$^3$ so that an n-type region is formed. Further, Si is diffused in the n-type region of the semiconductor substrate 1 at a concentration of, for example, $1\times10^{18}$ atoms/cm$^3$ so that the contact regions 3 and 4 of n+-type are formed. Various impurity diffusing processes such as an ion implantation process are known. The connection electrodes 5 and 6 are formed on the contact regions 3 and 4, respectively, by a known process such as a wiring pattern forming process. The connection electrodes 5 and 6 may be formed at the same time as the microstrip lines are formed. The connection electrodes 5 and 6 make ohmic contacts with the contact regions 3 and 4, respectively.

Figure 4B:
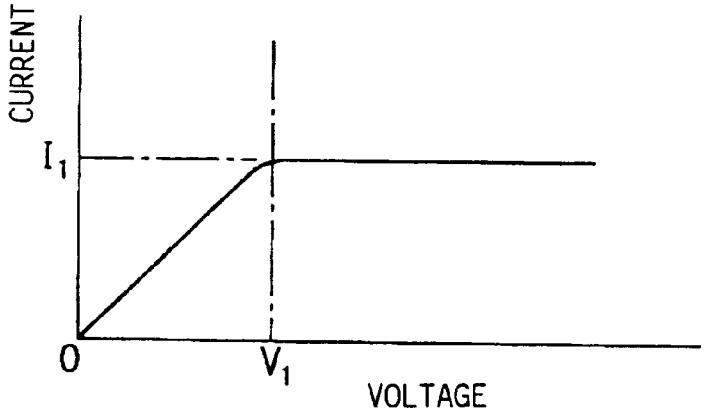
FIG. 4B is a graph showing a current vs voltage characteristic of the variable attenuator.

A dc voltage generated by the variable dc source 7 is applied across the connection electrodes 5 and 6. At this time, an approximately constant current flows when the dc voltage is equal to or higher than a given level. As shown in FIG. 4B, when the dc voltage is equal to or greater than $V_1$, the current is fixed to $I_1$. Hence, the resistance of the variable attenuator is increased as the dc voltage is increased from the voltage $V_1$.

Figure 4C:
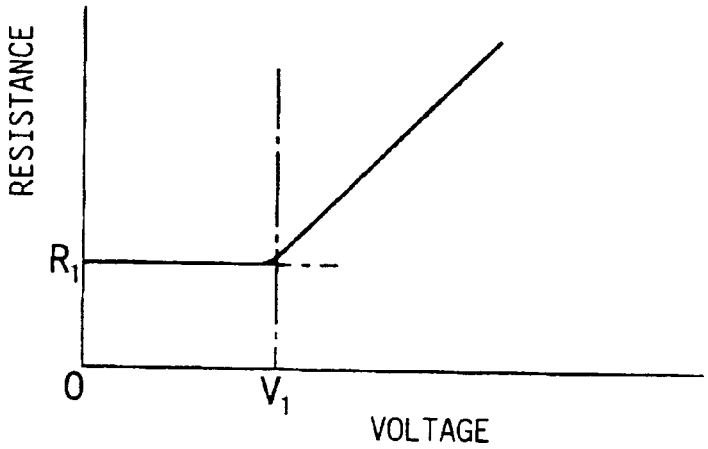
FIG. 4C is a graph showing a resistance vs voltage characteristic of the variable attenuator.

Generally, the velocity of electrons in the impurity diffused region 2 is expressed as $v=\mu E$ where $\mu$ denotes the mobility of electrons and E denotes the electric field. For example, when an electric intensity of 3 kV/cm is applied, the velocity of electrons becomes out of the proportional relationship with the electric field E and is decreased in contrast. Hence, as shown in FIGS. 4B and 4C, the velocity v of electrons is increased and an increased amount of current flows with an increase in the dc voltage applied to the impurity diffused regions 2 when the dc voltage is equal to or lower than the voltage $V_1$. In contrast, when the dc voltage higher than the voltage $V_1$ is applied, the current is not increased due to a decrease in the velocity v of electrons but is constant at $I_1$. In other words, the resistance is increased when the dc voltage is equal to or greater than the voltage $V_1$.

The variable attenuator of the present invention is different from the Gunn diode. The Gunn diode employs a GaAs substrate in which a contact region (corresponding to the contact region 3) is a high concentration region of $n^{++}$ as high as $1\times10^{19}$-$1\times10^{22}$ atoms/cm$^3$. A contact region of the Gunn diode (corresponding to the contact region 3) is an $n^+$-type region having a concentration of $1\times10^{18}$ atoms/cm$^3$. Hence, the Gunn diode has a negative resistance performance within a given range of the voltage applied thereto. The threshold of electric field at which a variation in the average velocity of electrons is zero is approximately equal to 3.4 kV/cm. The Gunn diode can be oscillated at very high frequencies by applying the voltage exceeding the threshold of electric field.

In contrast, the contact regions 3 and 4 provided at both sides of the impurity diffused region 2 have an impurity concentration of $1$–$3\times10^{18}$ atoms/cm$^3$ as large as that of the GaAs substrate 1.

The impurity diffused region 2 can be selected so as to fall within a range having a tolerance of ±10% of the impurity concentration $1\times10^{17}$ atoms/cm$^3$. The n-type resistance region 2 is formed by diffusing an impurity such as Si in the GaAs substrate 1, an advantage of such is that the large electron mobility can be utilized. Alternatively, a p-type impurity diffused region can be used. It is also possible to use a semiconductor substrate other than the GaAs substrate when such an alternative substrate can realize very high frequency circuit components such as low-noise amplifiers. The impurity concentrations of the impurity diffused region 2 and the contact regions 3 and 4 can be selected taking into account the materials of the semiconductor substrate 1 and the impurity to be diffused therein.

Figure 5:
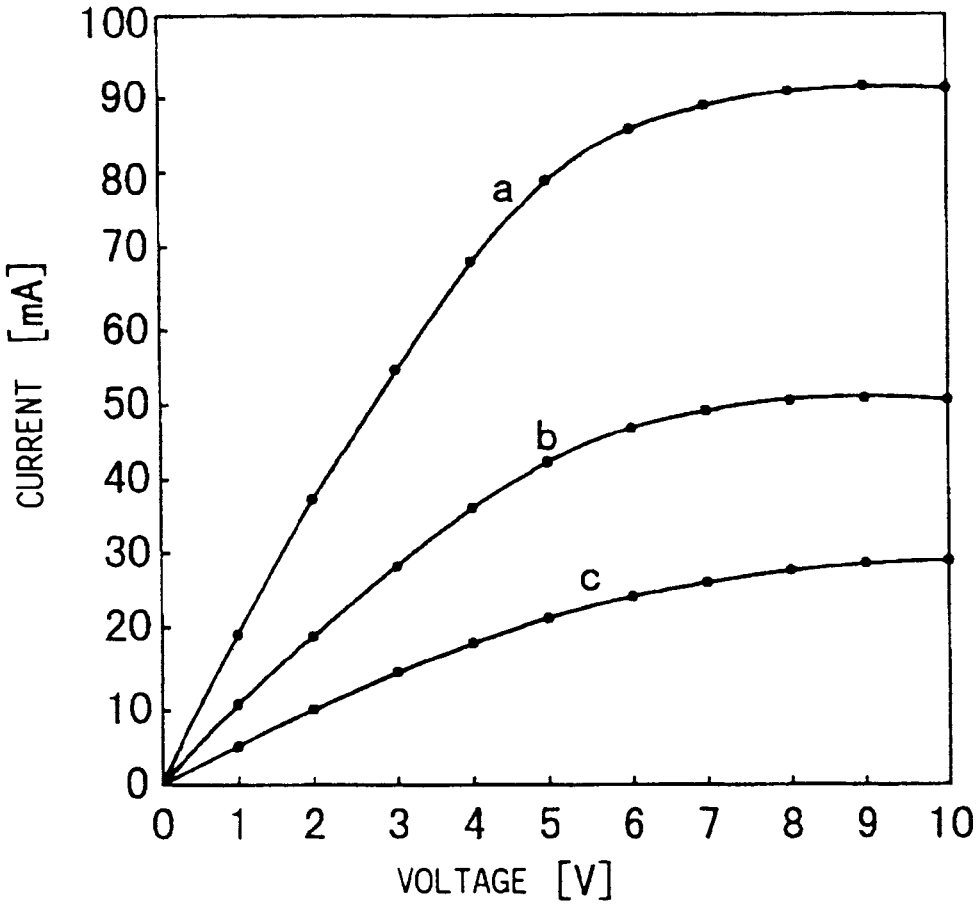
FIG. 5 is a graph of a current vs voltage characteristic of a variable attenuator shown in FIG. 2B.
Figure 6:
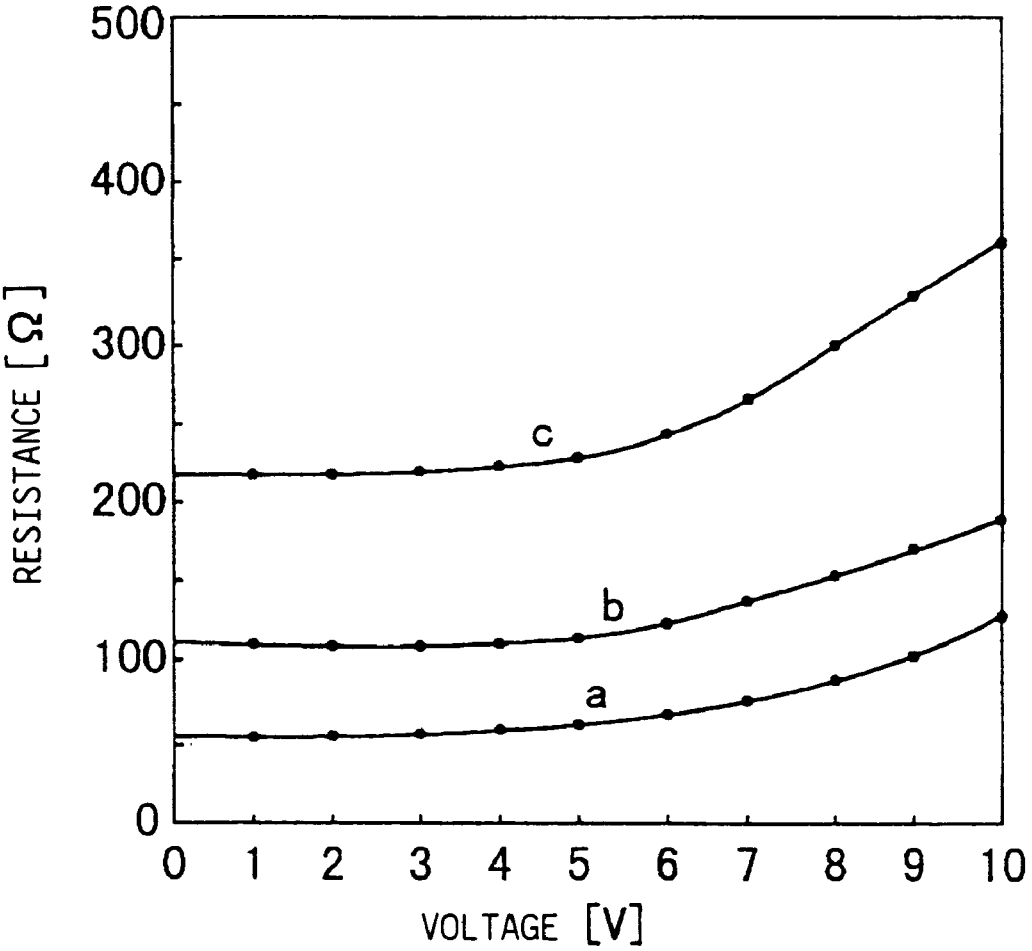
FIG. 6 is a graph of a resistance vs voltage characteristic of the variable attenuator shown in FIG. 2B.

FIGS. 5 and 6 are respectively graphs of a current vs voltage characteristic and a resistance vs voltage characteristic of the variable attenuator 12 obtained in experiments. More particularly, curves a, b and c in FIGS. 5 and 6 were obtained when the length L and width W of the resistance region 12A shown in FIG. 3B were selected as follows:

Curve a: L=20 $\mu$m, W=80 $\mu$m

Curve b: L=20 $\mu$m, W=40 $\mu$m

Curve c: L=20 $\mu$m, W=20 $\mu$m. The horizontal axes of the graphs of FIGS. 5 and 6 denote the dc voltage (V) applied to the resistance region 12A. The vertical axis of the graph of FIG. 5 denotes current (mA), and the vertical axis of the graph of FIG. 6 denotes resistance (Ω).

Figure 7:
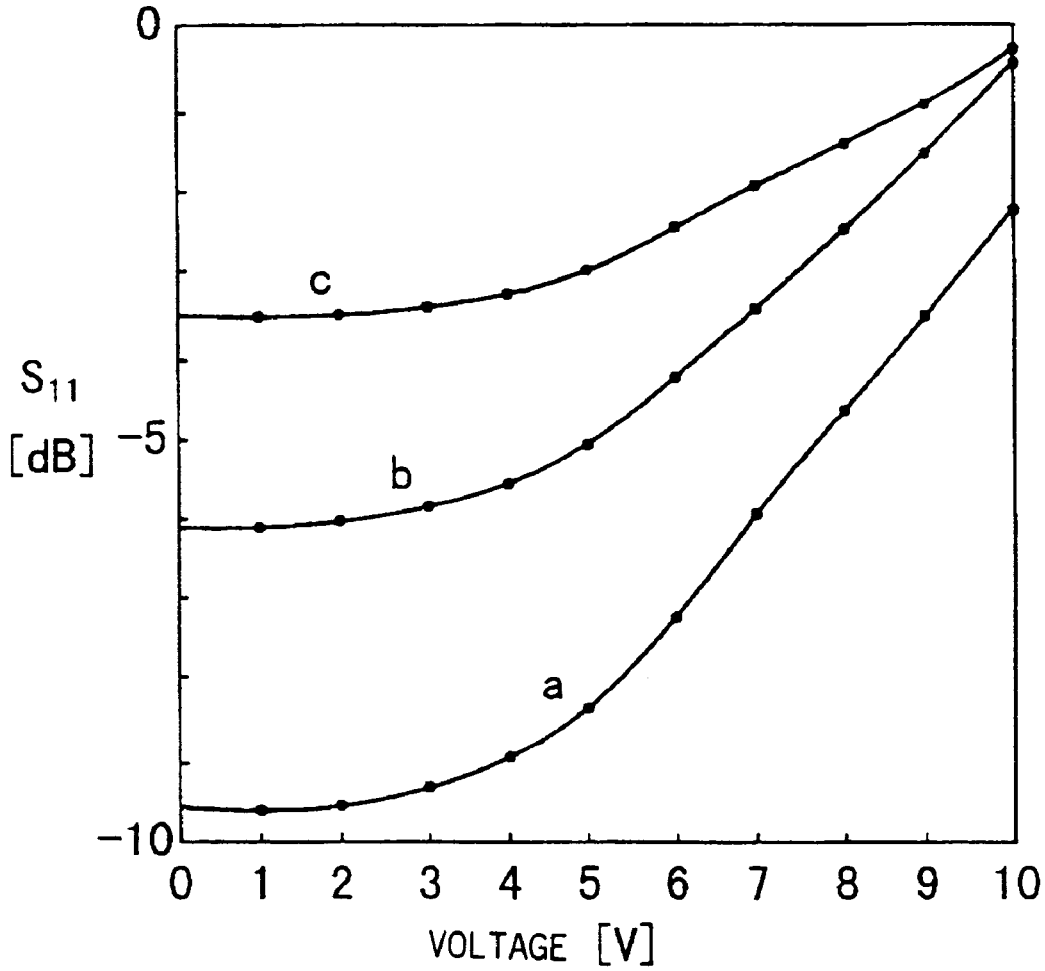
FIG. 7 is a graph of a reflection characteristic of the variable attenuator shown in FIG. 2B.
Figure 8:
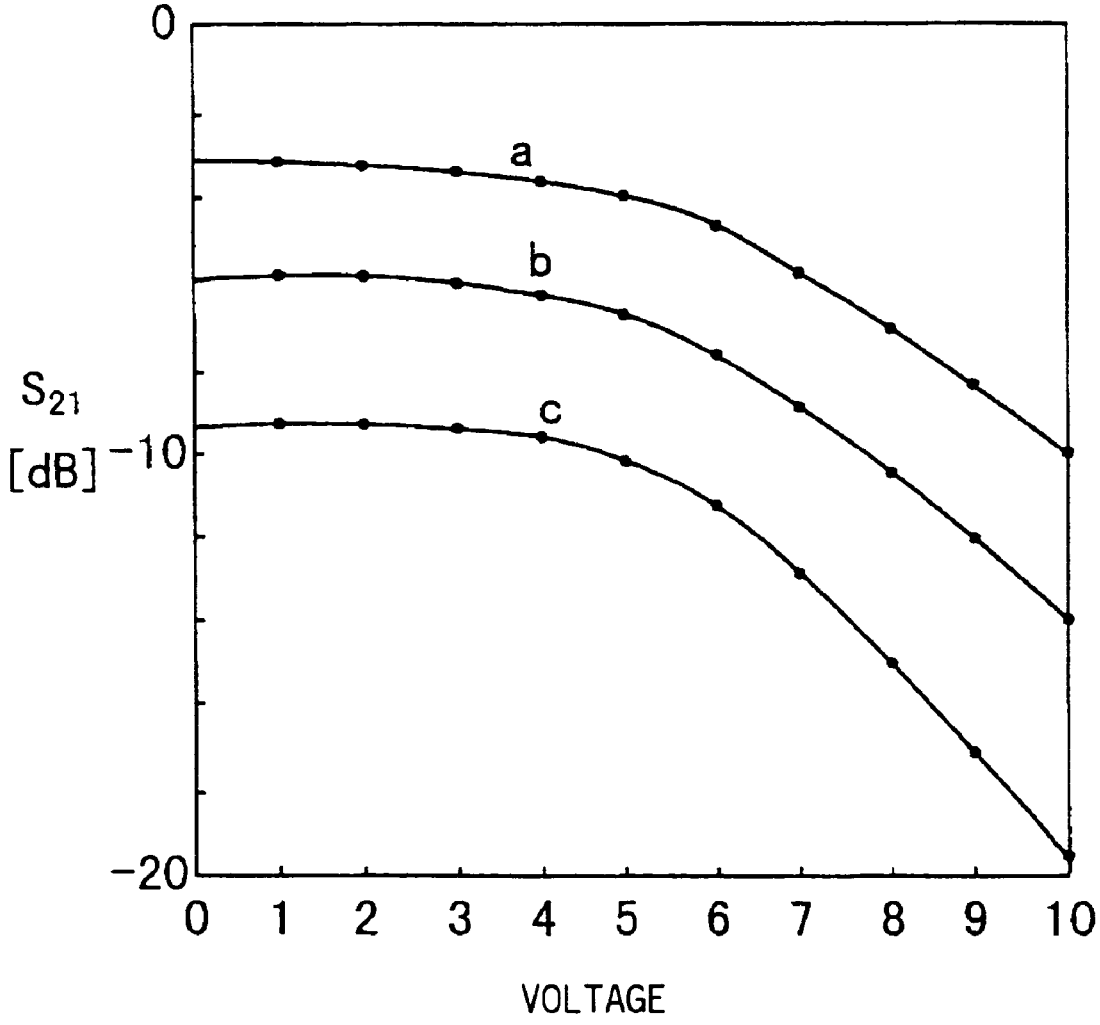
FIG. 8 is a graph of an attenuation characteristic of the variable attenuator shown in FIG. 2B.

FIG. 7 is a graph of a reflection characteristic of the variable attenuator 12 and FIG. 8 is a graph of an attenuation characteristic thereof. The curves a, b and c were obtained under the same conditions as those described above. The horizontal axes of the graphs of FIGS. 7 and 8 denote the dc voltage (V) applied to the resistance region 12A. The vertical axes of the graphs of FIGS. 7 and 8 denote $S_{11}$ (dB)

and $S_{21}$ (dB), respectively. It can be seen from the above graphs that an increase in the resistance of the impurity-diffused region 2 can be observed when the applied voltage is equal to or greater than 5 V. Hence, the variable attenuator having the characteristics shown in FIGS. 5–8 is provided in series to the transmission line over which the very high frequency signal is transferred, the magnitude of attenuation depending on the applied voltage value can be obtained.

Hence, the MMIC device shown in FIG. 3A which can be located at the receive front end is capable of controlling the magnitude of attenuation to adjust the very high frequency signal applied to the frequency converter 13 on the basis of the dc voltage applied across the opposing ends of the resistance region 12A of the variable attenuator 12 so that the signal level falls within the predetermined range.

Figure 9:
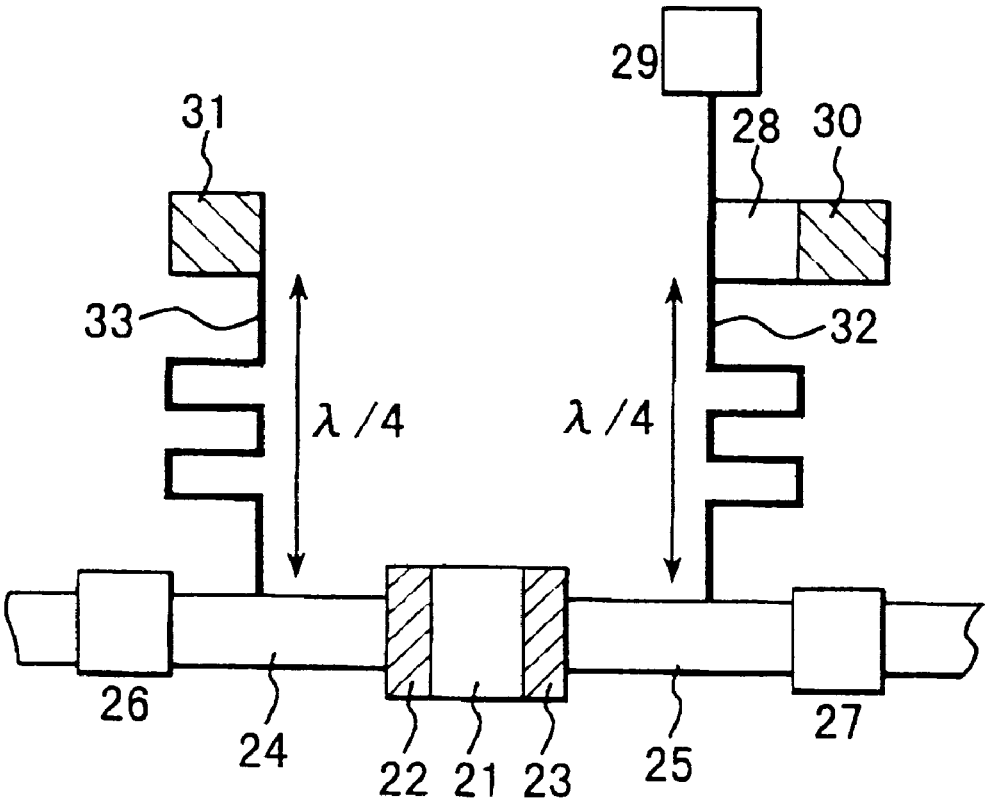
FIG. 9 is a diagram of a circuit pattern of a variable attenuator according to a first embodiment of the present invention.

FIG. 9 is a diagram of a circuit pattern of a variable attenuator according to a first embodiment of the present invention. The variable attenuator shown in FIG. 9 includes a resistance region 21, connection electrodes 22 and 23, signal lines 24 and 25, capacitors 26–28, a bonding pad 29, via holes 30 and 31, and ¼ wavelength lines 32 and 33. The resistance region 21 is formed by diffusing an impurity in a semiconductor substrate. The signal lines 24 and 25 are, for example, microstrip lines. The capacitors 26–28 function to cut dc components. A dc voltage is applied to the bonding pad 29. The via holes 30 and 31 are used for grounding. The ¼ wavelength lines 32 and 33 prevent passage of very high frequency signals while allowing dc voltages to pass therethrough. For the sake of simplicity, FIG. 9 does not show a dc current source which generates the dc voltage applied to the bonding pad 29 in order to control the magnitude of attenuation. A voltage applying part which applies the dc voltage across both ends of the resistance region 21 is formed by the dc current source and the ¼ wavelength lines 32 and 33. In FIG. 9, symbol λ denotes the wavelength of the very high frequency signal. FIG. 9 illustrates the resistance region 21 so as to be wider than the signal lines 24 and 25. In practice, the resistance region 21 can be designed to have an appropriate width based on the required initial resistance value.

A bias choke is formed by the capacitor 28 connected to the bonding pad 29 and the ¼ wavelength line 32. When the dc voltage is applied to the bonding pad 29, the dc voltage is applied across both ends of the resistance region 21 through a path formed of parts 32, 25, 23, 21, 22, 24, 33 and 31 in that order. The very high frequency signal is propagated through a path having the capacitor 26, the signal line 24, the connection electrode 22, the resistance region 21, the connection electrode 23, the signal line 25 and the capacitor 27. Hence, it is possible to regulate the magnitude of attenuation to the very high frequency signal on the basis of the dc voltage applied across both ends of the resistance region 21. For example, as the dc voltage increases, an increased magnitude of attenuation can be obtained.

Figure 10:
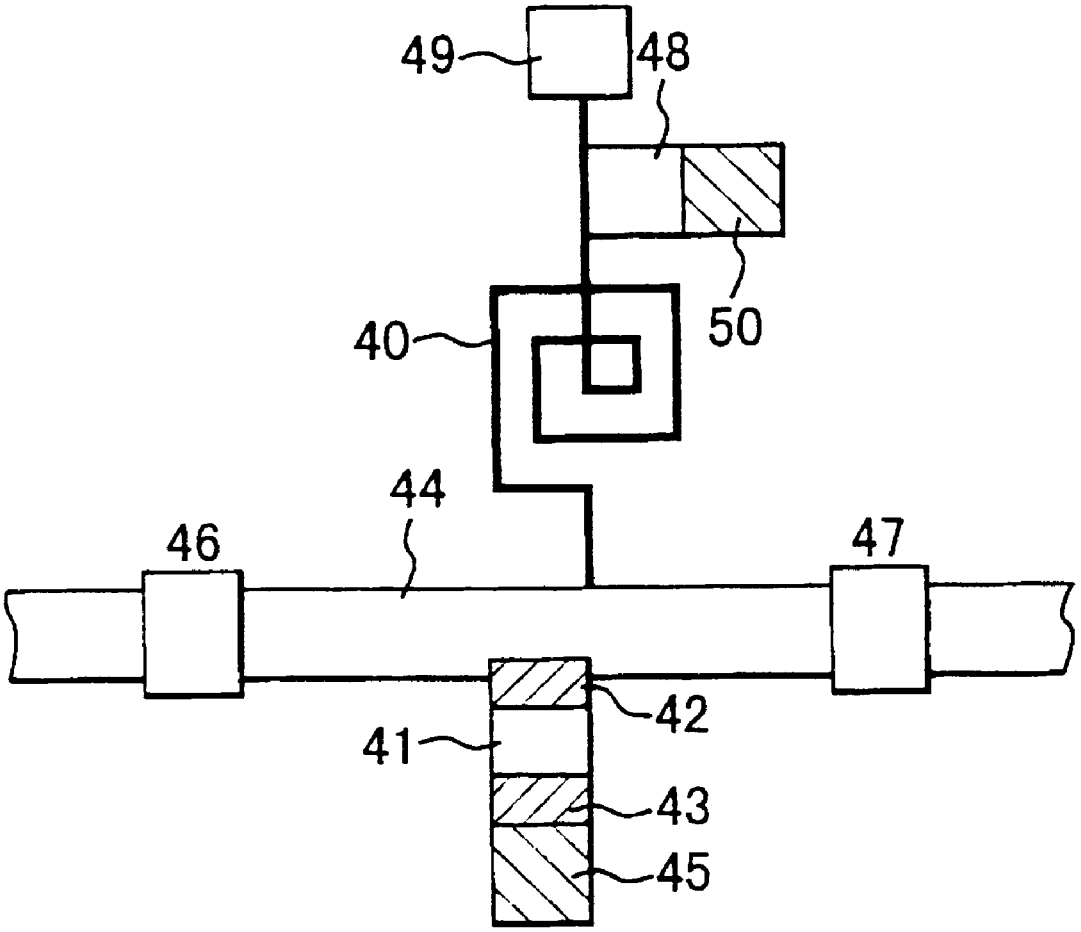
FIG. 10 is a diagram of a circuit pattern of a variable attenuator according to a second embodiment of the present invention.

FIG. 10 is a diagram of a circuit pattern of a variable attenuator according to a second embodiment of the present invention. The variable attenuator shown in FIG. 10 includes a spiral inductor 40, a resistance region 41, connection electrodes 42 and 43, a signal line 44, via holes 45 and 50, capacitors 46–48, and a bonding pad 49. The via holes 45 and 50 are used for grounding. The capacitors 46–48 cut dc components. The bonding part 49 receives a dc voltage for controlling the magnitude of attenuation.

The very high frequency signal is propagated through the capacitor 46, the signal line 44 and the capacitor 47. The spiral inductor 40 is a wiring pattern of a spiral shape provided between the bonding pad 49 and the signal line 44. The spiral inductor 40 prevents the very high frequency signal transferred over the signal from being applied to the dc source via the bonding pad 49.

The resistance region 41 is connected between the signal line 44 and the via hole 45. When the dc voltage is applied to the bonding pad 49, the dc voltage is applied across both ends of the resistance region 41 along a path having the parts 49, 40, 44, 42, 41, 43 and 45 in that order. The dc components are prevented from being transferred over the signal line due to the function of the capacitors 46 and 47. As the dc voltage applied to the bonding pad 49 is increased, the resistance region 41 has an increased resistance value. Hence, the variable attenuator has a decreased magnitude of attenuation to the very high frequency signal transferred over the signal line 44. In contrast, as the dc voltage applied to the bonding pad 49 is reduced, an increased magnitude of attenuation can be obtained.

Figure 11A:
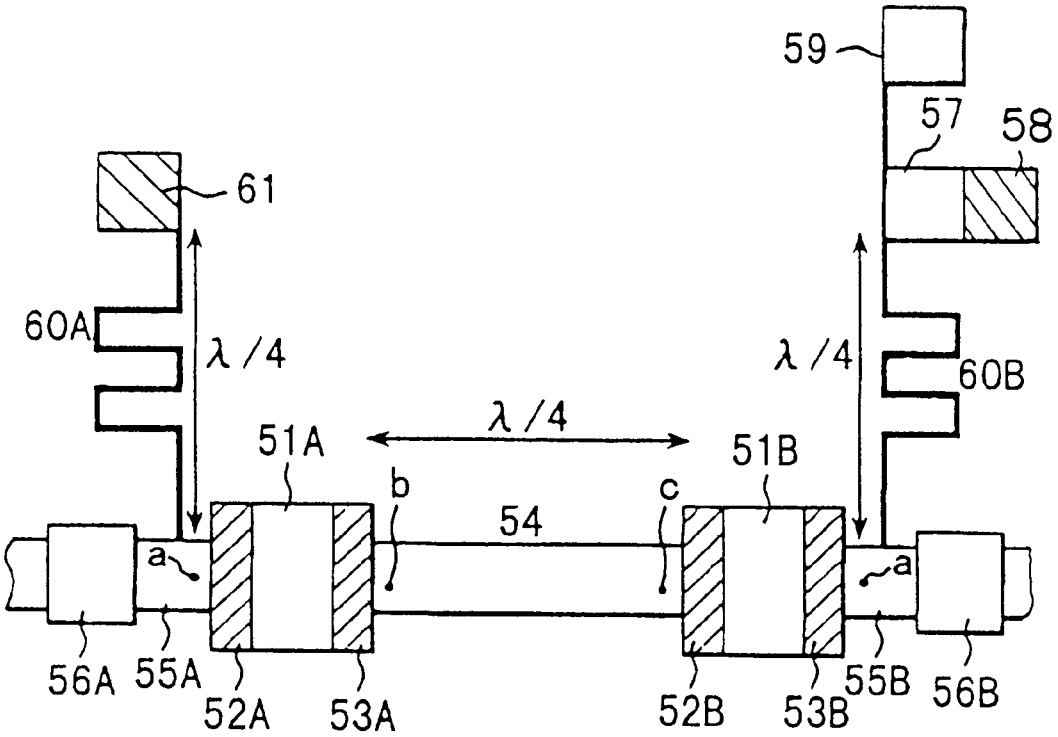
FIG. 11A is a diagram of a circuit pattern of a variable attenuator according to a third embodiment of the present invention.
Figure 11B:
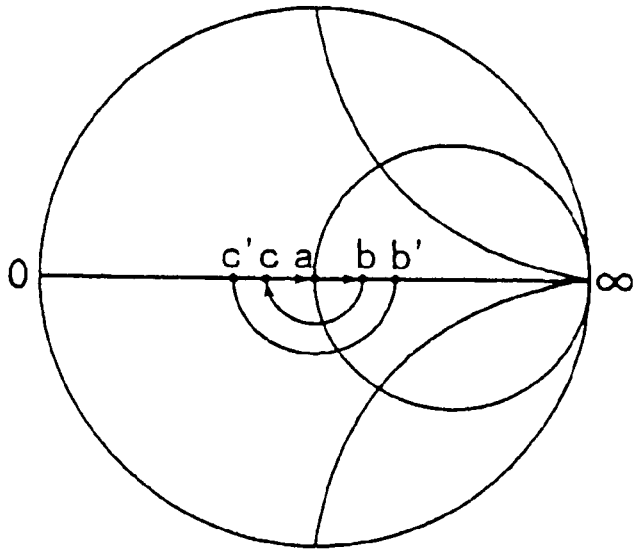
FIG. 11B is a Smith chart of the variable attenuator shown in FIG. 11A.

FIG. 11A is a diagram of a circuit pattern of a variable attenuator according to a third embodiment of the present invention. FIG. 11B is a Smith chart of the variable attenuator shown in FIG. 11A. The pattern shown in FIG. 11A includes a first resistance region 51A, , second resistance region 51B, connection electrodes 52A, 52B, 53A and 53B, signal lines 54, 55A and 55B, capacitors 56A, 56B and 57, via holes 58 and 61, a bonding pad 59 and ¼ wavelength lines 60A and 60B.

The first and second resistance regions 51A and 51B are spaced apart from each other by a distance of ¼ wavelength, and are connected together by the signal line 54. The dc voltage for controlling the magnitude of attenuation is applied to the bonding pad 59, the dc voltage is applied across both ends of each of the first and second resistance regions 51A and 51B via a path having the parts 59, 60B, 55B, 53B, 51B, 52B, 54, 53A, 51A, 52A, 55A, 60A and 61 in that order.

If the first and second resistance regions 51A and 51B have an identical structure, equal dc voltages are applied across the respective ends of the resistance regions 51A and 51B, and the resistance values thereof are varied based on the magnitude of the applied dc voltages. Hence, it is possible to control the magnitude of attenuation of the very high frequency signal transferred over the signal lines 55A, 54 and 55B and the capacitors 56A and 56B.

If the capacitors 56A and 56B are respectively defined as the input and output sides of the variable attenuator and the load impedance on the output side is equal to the characteristic impedance, the impedance at point "a" on the signal line 55A shown in FIG. 11A is located at "a" on the Smith chart of FIG. 11B. Due to the resistance of the first resistance region 51A, point "b" on the signal line 54 is located at "b" on the Smith chart of FIG. 11B. The phase is rotated by ¼ wavelength due to the ¼ wavelength signal line 54, and the impedance at point "c" shown in FIG. 11A is located at "c" on the Smith chart of FIG. 11B. The resistance of the second resistance region 51B is equal to that of the first resistance region 51A. Hence, point "a" on the signal line 55B has the impedance of "a" on the Smith chart of FIG. 11B. That is, the input impedance is maintained so as to be equal to the characteristic impedance.

Hence, if the dc voltages applied across both ends of the first and second resistance regions 51A and 51B increase, the impedance at point "a" on the signal line 55A is located at "a" on the Smith chart, and the impedance at point "b" on the signal line 54 is located at "b" on the Smith chart due to the resistance component of the first resistance region 51A. The impedance at point "c" on the signal line 54 having a length equal to ¼ wavelength is located at point "c" on the Smith chart. Due to the resistance component of the second resistance region 51B, the impedance at point "a" on the signal line 55B is located at "a" on the Smith chart. Hence, even if the magnitude of attenuation to the very high frequency is changed, the input impedance can be maintained so as to be equal to the characteristic impedance. Thus, the performance of the variable attenuator can be improved.

Figure 12:
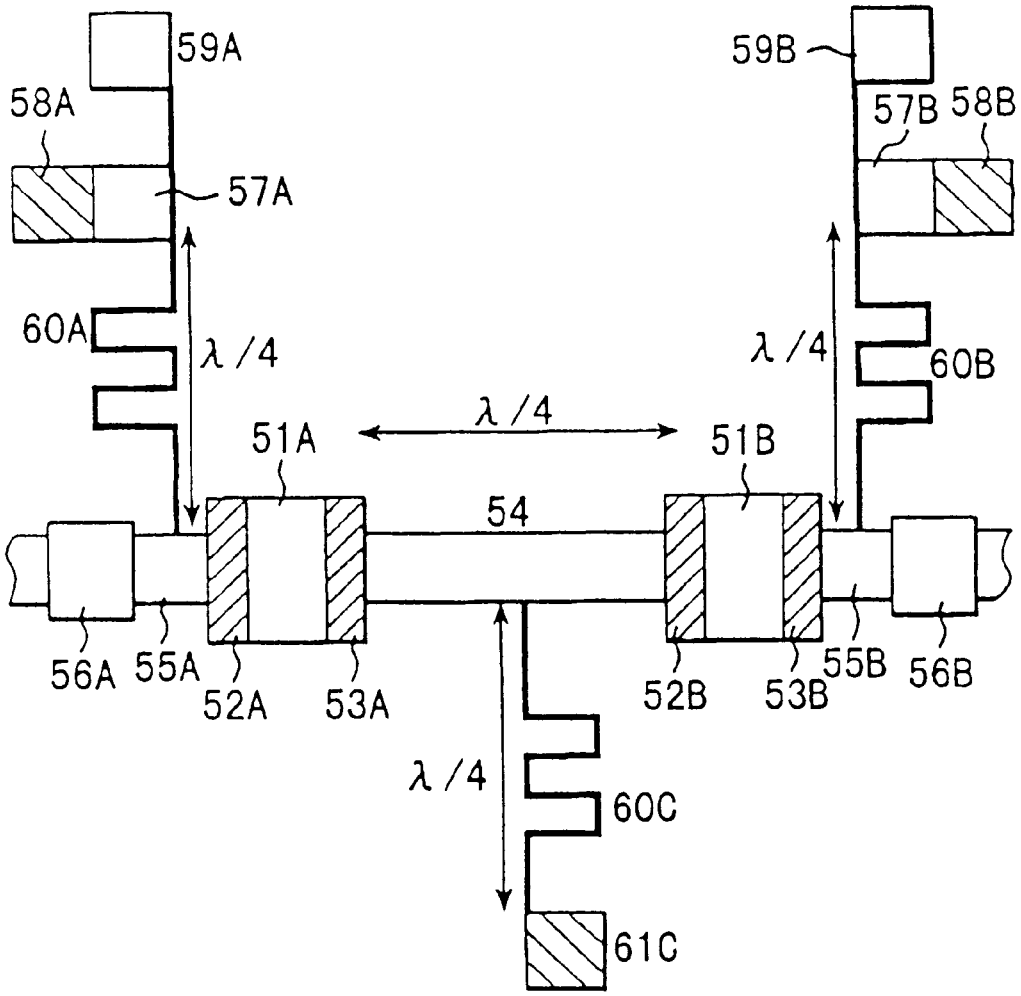
FIG. 12 is a diagram of a circuit pattern of a variable attenuator according to a fourth embodiment of the present invention.

FIG. 12 is a diagram of a circuit pattern of a variable attenuator according to a fourth embodiment of the present invention. The variable attenuator shown in FIG. 12 includes the above-mentioned first resistance region 51A, the second resistance region 51B, the connection electrodes 52A, 52B, 53A and 53B, the signal lines 54, 55A and 55B, the capacitors 56A, 56B, 57A and 57B, via holes 58A, 58B and 61C, the bonding pads 59A and 59B, and ¼ wavelength lines 60A, 60B and 60C.

The first and second resistance regions 51A and 51B are connected through the signal line 54 having the length equal to ¼ wavelength. This is the same as that shown in FIG. 11A. According to the fourth embodiment of the present invention, the signal line 54 is coupled to the ground through the ¼ wavelength line 60C and the via hole 61C. The first resistance region 51A is supplied with the dc voltage via the bonding pad 59A and the ¼ wavelength line 60A. The dc voltage is supplied to the second resistance region 51B via the bonding pad 59B and the ¼ wavelength line 60B. That is, the different dc voltages can be respectively applied to the first and second resistance regions 51A and 51B.

With the above structure, it is possible to reduce a variation in the input impedance even by controlling the magnitude of attenuation to the very high frequency signal. That is, in the Smith chart of FIG. 11B, the resistance at the right-hand side of the center "a" is plotted at intervals different from those for the resistance at the left-hand side thereof. Hence, a fine change of the resistance is negligible, while a large change thereof is not negligible.

Hence, the dc voltage applied across the first resistance region 51A and the dc voltage applied across the second resistance region 51B are set different from each other so that the impedance characteristic which rotates by ¼ wavelength returns to the origin, namely, "a". Hence, a change of the input impedance can further be suppressed.

Figure 13:
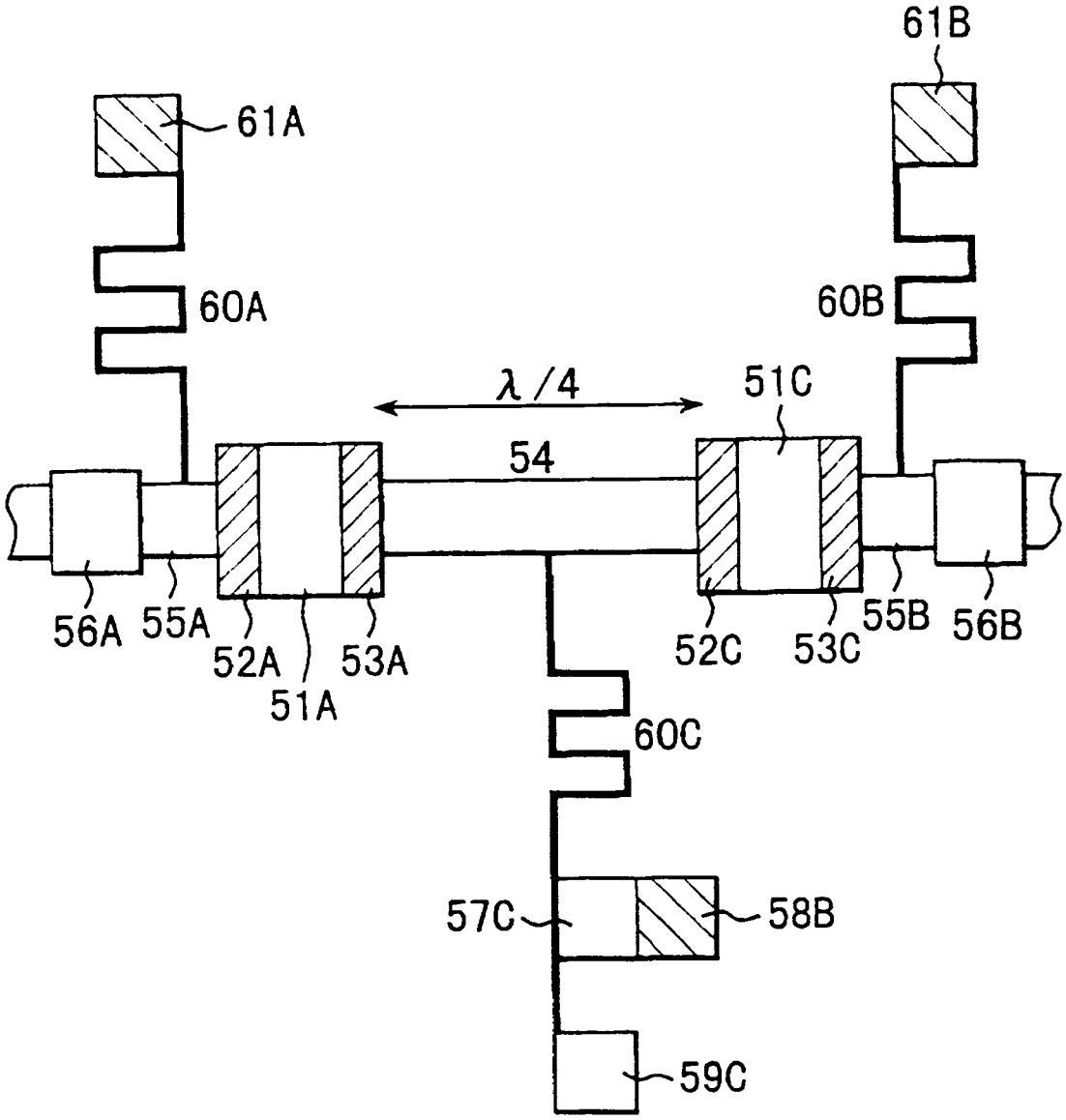
FIG. 13 is a diagram of a circuit pattern of a variable attenuator according to a fifth embodiment of the present invention.

FIG. 13 is a diagram of a circuit pattern of a variable attenuator according to a fifth embodiment of the present invention. The circuit pattern shown in FIG. 13 has the first and second resistance regions 51A and 51B, connection electrodes 52A, 52C, 53A and 53C, signal lines 54, 55A and 55B, capacitors 56A, 56B and 57C, via holes 61A and 61B, bonding pad 59C and ¼ wavelength lines 60A, 60B and 60C.

In the circuit pattern shown in FIG. 13, the width of the second resistance region 51C is reduced so as to have a resistance value greater than that of the first resistance region 51A. Equal dc voltages are applied to the first and second resistance regions 51A and 51C via the bonding pad 59C. That is, the dc voltage is applied to the first resistance region 51A through a path of components 59C, 60C, 54, 53A, 51A, 52A, 55A, 60A and 61A in that order. The dc voltage is applied to the second resistance region 51C through a path of components 59C, 60C, 54, 52C, 51C, 53C, 55B, 60B and 61B.

The first and second resistance regions 51A and 51C are formed beforehand so as to have different resistance values. Hence, even if the equal dc voltages are applied to the first and second resistance regions 51A and 51C, a change in the magnitude of attenuation does not greatly change the input impedance, as in the case of the configuration shown in FIG. 12. It is also possible to form the first and second resistance regions 51A and 51C so that they have different dimensions and to further apply different dc voltages thereto. In this case, the second resistance region 51B shown in FIG. 12 is replaced by the second resistance region 51C shown in FIG. 13. Hence, it is possible to further reduce variation in the input impedance caused by the control of the magnitude of attenuation.

Figure 14A:
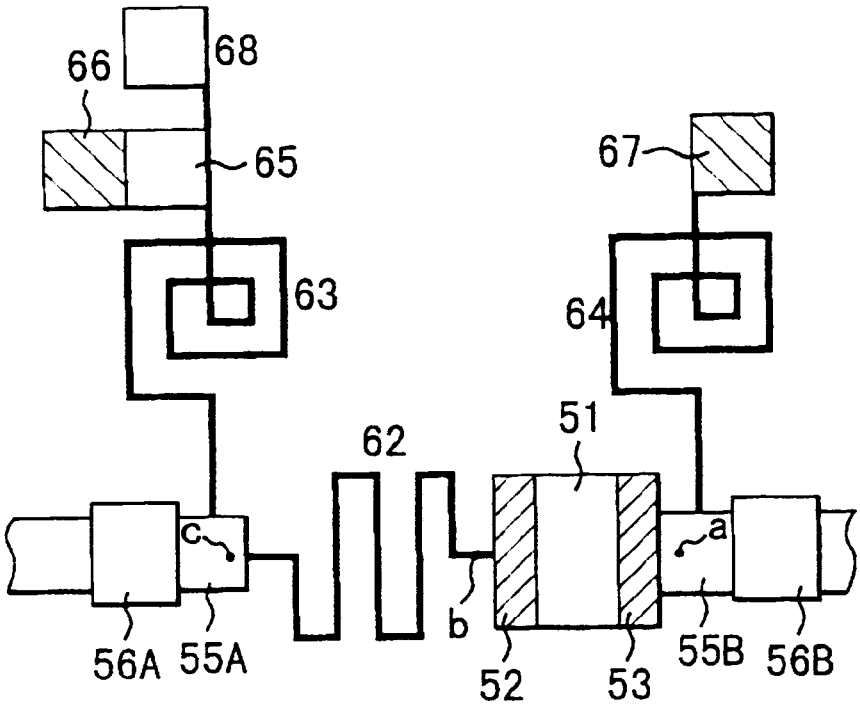
FIG. 14A is a diagram of a circuit pattern of a variable attenuator according to a sixth embodiment of the present invention.
Figure 14B:
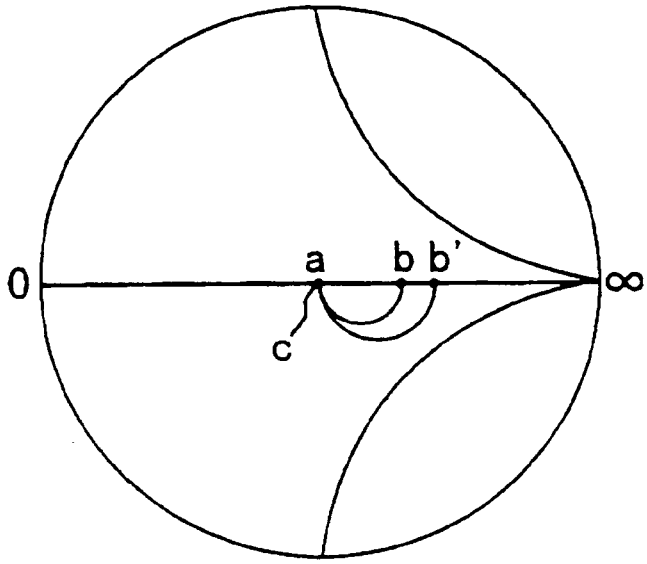
FIG. 14B is a Smith chart of the variable attenuator shown in FIG. 14A.

FIG. 14A is a diagram of a circuit pattern of a variable attenuator according to a sixth embodiment of the present invention. FIG. 14B is a Smith chart of the variable attenuator shown in FIG. 14A. The variable attenuator includes the resistance region 51, connection electrodes 52 and 53, signal lines 55A and 55B, capacitors 56A, 56B and 65, a high-impedance line 62 having a length equal to the ¼ wavelength, spiral inductors 63 and 64, via holes 66 and 67 and bonding pad 68. The high-impedance line 62 has a width narrower than the widths of the signal lines 55A and 55B in order to have a high impedance. The high-impedance line 62 having the length of the¼ wavelength shown in FIG. 14A has a unique shape, but may have an arbitrary shape such as a straight line.

When the dc voltage is applied to the bonding pad 68, the dc voltage is applied across the resistance region 51 via the path of components 68, 63, 55A, 62, 52, 51, 53, 55B, 64 and 67 in that order. The magnitude of attenuation to the very high frequency signal can be controlled by controlling the dc voltage. In this case, point "a" on the signal line 55B is located at "a" and, point "b" on the high-impedance line 62 is located at "b" as shown in FIG. 14B, respectively, due to the resistance of the resistance region 51. A point "c" on the signal line 55A is located at "c" shown in FIG. 14B because the high-impedance line 62 has the length of ¼ wavelength. That is, the impedance at point "c" is equal to that at point "a".

When the dc voltage applied across both the ends of the resistance region 51 is increased so that the resistance region 51 has an increased resistance value, the point "b" of the high-impedance line 62 corresponds to point b' shown in FIG. 14B. Because the high-impedance line 62 has the length equal to ¼ wavelength, the point "c" on the signal line 55A rotates by ¼ wavelength, and is located at point "c" shown in FIG. 14B. That is, the impedance at the point "c" is equal to that at the point "a".

Hence, the input impedance can be maintained at the characteristic impedance when the dc voltage is applied across the ends of the resistance region 51 to control the magnitude of attenuation to the very high frequency signal. Thus, the present variable attenuator can be used in the very high frequency band. Further, as compared with the configurations shown in FIGS. 11A, 12 and 13, the compact variable attenuator can be realized because only one resistance region 51 is used.

Figure 15:
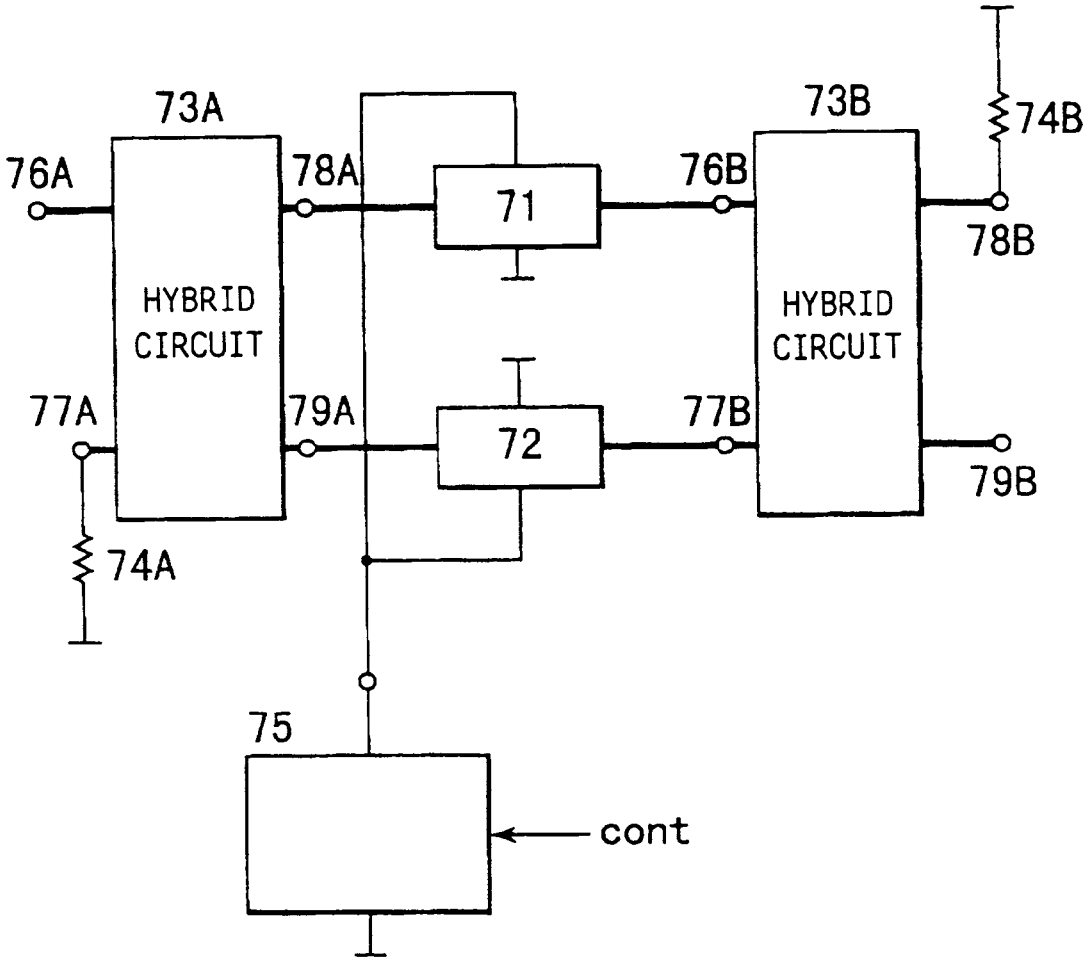
FIG. 15 is a block diagram of a variable attenuator according to a seventh embodiment of the present invention.

FIG. 15 is a block diagram of a variable attenuator according to a seventh embodiment of the present invention. The variable attenuator shown in FIG. 15 includes first and second attenuators 71 and 72 respectively including resistance regions formed of impurity diffused regions, first and second hybrid circuits 73A and 73B, termination resistors 74A and 74B, a voltage applying unit 75, and terminals 76A–79A and 76B–79B. The voltage applying unit 75 changes the output dc voltage in accordance with a control signal cont supplied from the outside of the variable attenuator.

The first and second attenuators 71 and 72 may have the configuration shown in FIG. 9 or FIG. 10. The first attenuator 71 is connected between the terminal 78A of the first hybrid circuit 73A and the terminal 76B of the second hybrid circuit 73B. The second attenuator 72 is connected between the terminal 79A of the first hybrid circuit 73A and the terminal 77B of the second hybrid circuit 73B. Hence, the first and second resistance regions are connected between the hybrid circuits 73A and 73B. The dc voltage generated by the voltage applying unit 75 is applied across the ends of the first and second attenuators 71 and 72.

The terminal 76A of the first hybrid circuit 73A is used as an input terminal, and the terminal 79B of the second hybrid circuit 73B is used as an output terminal. The termination resistor 74A is connected to the terminal 77A of the first hybrid circuit 73A, and the termination resistor 74B is connected to the terminal 78B of the second hybrid circuit 73B.

When the dc voltage based on the control signal cont and supplied from the voltage applying unit 75 is applied to the first and second attenuators 71 and 72 to control the resistance values thereof, the impedance matching between the terminals 78A and 79A of the first hybrid circuit 73A and the first and second attenuators 71 and 72 is destroyed and a reflection wave occurs. However, the reflection wave is canceled and does not appear at the input terminal 76A of the hybrid circuit 73A. That is, the impedance viewed from the input terminal 76A does not change. Similarly, the output impedance of the output terminal 79B does not change. Hence, the variable attenuator shown in FIG. 15 stably operates in the very high frequency band.

The first and second hybrid circuits 73A and 73B may be formed of 90° couplers of various types. For example, a Lange coupler miniaturizes the variable attenuator, as compared to a branch line coupler.

Figure 16:
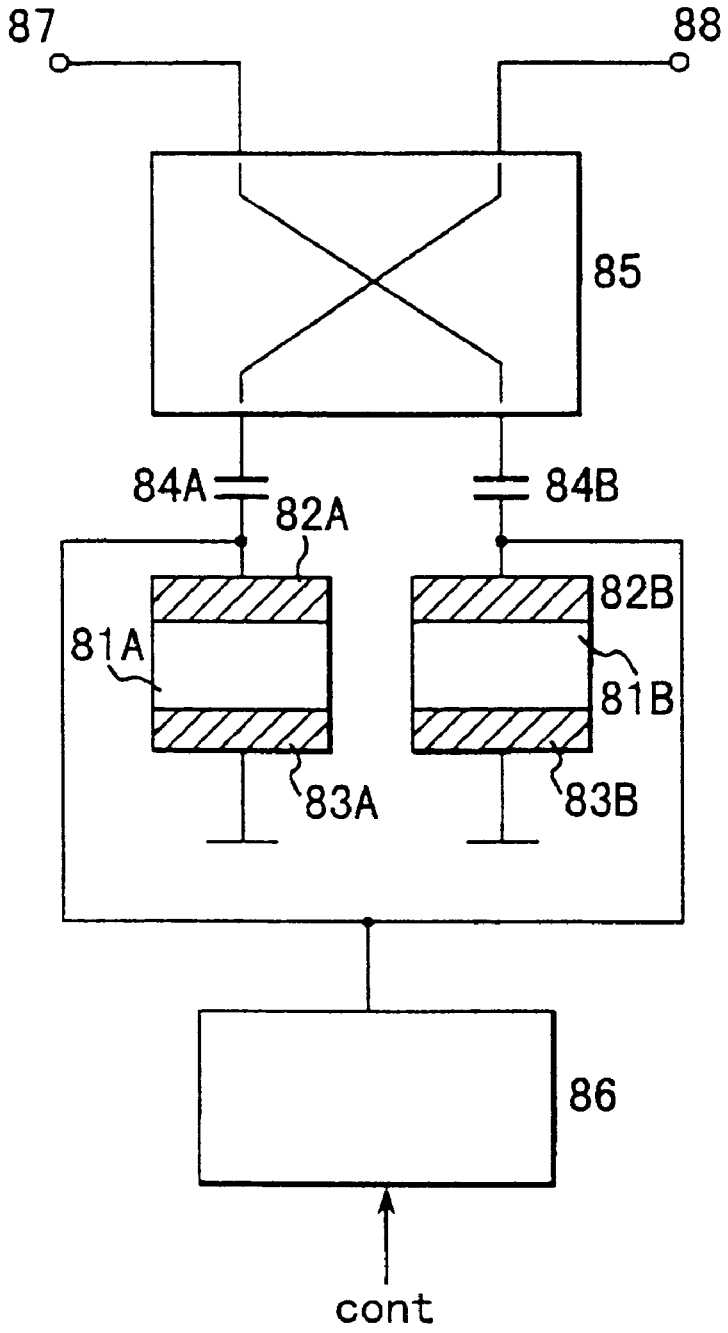
FIG. 16 is a diagram of a variable attenuator according to an eighth embodiment of the present invention.

FIG. 16 is a diagram of da variable attenuator according to an eighth embodiment of the present invention. The variable attenuator shown in FIG. 16 includes first and second resistance regions 81A and 81B, connection electrodes 82A, 83A, 82B and 83B, capacitors 84A and 84B for cutting dc components, a 90° hybrid circuit, a voltage applying unit 86, an input terminal 87 and an output terminal 88. The output terminal 88 is an isolation terminal with respect to the input terminal 87.

The first and second resistance regions 81A and 81B are coupled to the hybrid circuit 85 via the capacitors 84A and 84B. The voltage applying unit 85 is connected so that the dc voltage is applied to the ends of the first and second resistance regions 81A and 81B. The dc voltage supplied from the voltage applying unit 85 can be controlled by the control signal cont.

When the dc voltage supplied from the voltage applying unit 85 is applied across the ends of the first and second resistance regions 81A and 81B in order to increase the resistance values thereof, the amount of signal reflection is increased, and the magnitude of attenuation to the very high frequency signal from the input terminal 87 to the output terminal 88 is reduced. In contrast, when the dc voltage is reduced to decrease the resistance values of the first and second resistance regions 81A and 81B, the amount of signal reflection is decreased, and the magnitude of attenuation to the very high frequency signal from the input terminal 87 to the output terminal 88 is increased. The input impedance viewed from the input terminal 87 is not changed due to the control of the magnitude of attenuation.

The present invention is not limited to the specifically disclosed embodiments, and variations and modifications may be made without departing from the scope of the present invention. For example, the control signal cont applied to the voltage applying units 75 and 86 can be the detection signal PD of the level detection photodiode 14 shown in FIG. 3A. For example, when the detection signal PD is greater than a given value, the voltage applying unit 75 shown in FIG. 15 increases the dc voltage to increase the magnitude of attenuation, and the voltage applying unit 86 shown in FIG. 16 decreases the dc voltage to reduce the amount of reflection while the magnitude of attenuation is increased.

As described above, according to the present invention, the dc voltage is applied to the opposing ends of the resistance region 12A formed by diffusing an impurity in the semiconductor substrate 10 so that the magnitude of attenuation to the very high frequency signal can be controlled. Hence, the variable attenuator of the present invention can easily be implemented by the MMIC. Further, the first and second resistance regions are connected together by the signal line having the length equal to ¼ wavelength. With this structure, the input impedance can be maintained at the characteristic impedance even when the magnitude of attenuation can be controlled. Further, a compact variable attenuator can be realized. Thus, influence of the parasitic capacitance in the milliwave band is negligible. The present invention providers a variable attenuator having excellent performance in the very high frequency band such as the milliwave band.

The above-mentioned arrangement in which the first and second resistance regions are provided between the hybrid circuits can prevent a variation in the input impedance caused by the control of the magnitude of attenuation. Hence, a variable attenuator can be provided which stably operates at the very high frequency band. The above-mentioned arrangement in which the amount of reflection by the first and second resistance regions is controlled can prevent a variation in the input impedance caused by the control of the magnitude of attenuation.

What is claimed is:

1. A variable attenuator comprising:

a resistance region including an impurity-diffused semiconductor region;

a signal line to which the resistance region is connected, a very high frequency signal being propagated through the signal line; and a voltage applying part which contacts the resistance region in an ohmic contact formation and applies a dc voltage across the ends of the resistance region, the dc voltage controlling a magnitude of attenuation to the very high frequency signal.

2. The variable attenuator as claimed in claim 1, wherein:

the resistance region is provided in the signal line;

the variable attenuator further comprises capacitors provided in the signal line and located at both sides of the resistance region; and said voltage applying part comprises a portion which applies the dc voltage to both the sides of the resistance region and which interrupts the very high frequency signal.

3. The variable attenuator as claimed in claim 1, wherein:

the resistance region is connected between the signal line and ground; and said voltage applying part comprises a portion which applies the dc voltage to both the sides of the resistance region and which interrupts the very high frequency signal.

4. The variable attenuator as claimed in claim 1, wherein:

the resistance region is an impurity diffused region formed in a semiconductor substrate; and the signal line is formed on the semiconductor substrate.

5. A variable attenuator comprising:

first and second resistance regions, each including an impurity-diffused semiconductor region, which are spaced apart from each other by a length equal to ¼ ov a wavelength of a very high frequency signal;

a signal line to which the first and second resistance regions are connected, the very high frequency signal being propagated through the signal line; and a voltage applying part which contacts the resistance region in an ohmic contact formation and applied a dc voltage across the ends of the first and second resistance regions, the dc voltage controlling a magnitude of attenuation to the very high frequency signal.

6. A variable attenuator comprising:

first and second resistance regions, each including an impurity-diffused semiconductor region, which are spaced apart from each other by a length equal to ¼ of a wavelength of a very high frequency signal;

a signal line to which the first and second resistance regions are connected, the very high frequency signal being propagated through the signal line; and a voltage applying part which contacts the resistance region in an ohmic contact formation and applies different dc voltages across the ends of the fist and second resistance regions, the dc voltages controlling a magnitude of attenuation to the very high frequency signal.

7. The variable attenuator as claimed in claim 6, wherein the first and second resistance regions have different resistance values.

8. The variable attenuator as claimed in claim 6, further comprising a high-impedance line which has a length equal to ¼ of the wavelength of the very high frequency signal and which is provided in the signal line and is connected to the resistance region.

9. A variable attenuator comprising:

a first hybrid circuit connected to signal lines of an input side through which a very high frequency signal is propagated;

a second hybrid circuit connected to signal lines of an output side;

first and second resistance regions, each including an impurity-diffused semiconductor region, and connecting the first and second hybrid circuits together; and a voltage applying part which contacts the resistance region in an ohmic contact formation and applies a dc voltage across the ends of the first and second resistance regions, the dc voltage controlling a magnitude of attenuation to the very high frequency signal.

10. A variable attenuator comprising:

an input terminal receiving a very high frequency signal;

an output terminal;

a hybrid circuit operationally connected to said output terminal which distributes the very high frequency signal to first and second output terminals;

a first resistance region, including an impurity-diffused semiconductor region, connected between the first terminal of the hybrid circuit and ground;

a second resistance region, including an impurity-diffused semiconductor region, connected between the second terminal of the hybrid circuit and ground; and a voltage applying part which contacts the resistance region in an ohmic contact formation and applies a dc voltage across the ends of the first and second resistance regions, the dc voltage across the ends of the first and second resistance regions, the dc voltage controlling a magnitude of attenuation to the very high frequency signal so that signal reflection can be controlled.

* * * * *